US005293924A

United States Patent [19]

Hugens, Jr. et al.

[11] Patent Number: 5,293,924

[45] Date of Patent: Mar. 15, 1994

[54] MANUFACTURE OF COPPER ROD

[75] Inventors: John R. Hugens, Jr., Salt Lake City; Stephen L. Ferrel, West Jordan, both of Utah; Gary L. Spence, Amarillo, Tex.

[73] Assignee: ASARCO Incorporated, New York, N.Y.

[21] Appl. No.: 15,876

[22] Filed: Feb. 10, 1993

Related U.S. Application Data

[63] Continuation of Ser. No. 924,788, Aug. 5, 1992, abandoned, which is a continuation of Ser. No. 703,656, May 21, 1991, abandoned.

[51] Int. Cl.[5] ..... B22D 11/16

[52] U.S. Cl. ..... 164/452; 75/384

[58] Field of Search ..... 164/477, 452; 75/384, 75/376

[56] References Cited

U.S. PATENT DOCUMENTS 4,290,823 9/1981 Dompas ..... 75/384
4,907,440 3/1990 Martin et al. ..... 73/19

FOREIGN PATENT DOCUMENTS 57-39066 3/1982 Japan ..... 75/384
58-65557 4/1982 Japan ..... 75/384

*Primary Examiner*—Kuang Y. Lin
*Attorney, Agent, or Firm*—Kenneth A. Koch; John J. Tomaszewski

[57] ABSTRACT

A method is disclosed for improving the continuous casting process for making copper by using a probe and analyzer which measures the gases present in the molten copper and controls the process based on the analyzer results.

6 Claims, 3 Drawing Sheets

MANUFACTURE OF COPPER ROD

This is a continuation of copending application Ser. No. 07/924,788 filed on Aug. 5, 1992 which application is a continuation of application Ser. No. 07/703,656 filed on May 21, 1991, both now abandoned.

This invention relates to the manufacture of copper by continuous casting and, more particularly, to improving the manufacturing method and the quality of the copper product by controlling the process using an analyzer instrument employing a probe which is inserted into the molten copper and measures the gases present in the molten copper.

The manufacture of copper by continuous casting is well-known in the art. In the "Extractive Metallurgy of Copper" by A. K. Biswas and W. G. Davenport, First edition, Chapter 17, pages 336–368 the manufacturing process is described in detail and the disclosure is hereby incorporated by reference.

Basically, as described in Phillips et al., U.S. Pat. No. 3,199,977, which patent is hereby incorporated by reference, cathodes or other forms of copper are melted in a furnace and the molten copper fed to a holding furnace for casting. The Asarco shaft furnace is predominately employed and the copper is placed in the furnace at the top and is heated and melted as it descends down the shaft. The heat is provided by impinging and ascending combustion gases produced in burners near the bottom of the furnace.

The furnace is primarily a melting unit and the burners and combustion gases are such that the copper is generally not oxidized during melting. This is achieved by using specially designed burners which insure that unconsumed oxygen in the burner does not enter the furnace shaft and by controlling the fuel/air ratio of the burners to provide a slightly reducing atmosphere in the furnace. In general, the fuel/air ratio is controlled to provide a reducing flame having a hydrogen content of the combusted fuel of up to about 3% by volume, usually 1%–3%.

There is generally no holding capacity in the furnace bottom and the molten copper flows immediately into a separate burner fired holding furnace. In many installations the launder connecting the shaft furnace and the holding furnace is also burner fired to likewise maintain the temperature of the copper and to minimize unwanted oxidation of the copper.

Copper containing oxygen is the predominant product in the market today and for convenience the following description will be directed to this product although it will be understood to those skilled in the art that the method may be used for other copper products (e.g., oxygen free—less than 20 ppm oxygen) and other metals. One form is tough pitch copper which is characterized by a level surface (flat set) after open-mold casting. The copper contains up to about 500 ppm oxygen or higher, preferably, 100–450 ppm, and is present in the form of copper oxide which is soluble in the molten copper and which forms copper oxide grains in the solid copper. Generally, the oxygen level is controlled by introducing it into the copper by bubbling air through the molten copper in the holding furnace. Another method uses a burner in the holding furnace or launder having an oxidizing flame or reducing flame if necessary.

The molten copper from the holding furnace is then fed to a continuous caster such as a Properzi or Southwire wheel caster or a Hazelett twin belt caster. In the Hazelett caster, molten copper is cast between two coincidentally moving steel belts and the casting, usually a bar shape, is fed directly into a rod-rolling mill. The rod is normally discharged into a pickling unit, coiled and stored.

U.S. Pat. No. 4,290,823, granted to J. Dompas, shows the basic continuous casting process for manufacturing copper and this patent is hereby incorporated by reference. The Dompas process produces an oxygen containing rod product which purportedly has the advantages of oxygen free copper (ductility) and the annealing capacity of tough pitch copper. The process uses a solid electrolyte containing an electrochemical cell to analyze the oxygen content of the molten copper in the holding furnace and adjusts the fuel/air ratio of the holding zone burners to maintain the desired oxygen level.

An article entitled "Continuous Casting and Rolling of Copper Rod at the M. H. Olen Copper Refinery Uses No Wheel", by J. M. A. Dompas, J. G. Smets and J. R. Schoofs (Wire Journal, September 1979, pages 118–132) also shows a typical rod making process.

Regardless of the particular processes and controls used, the main concern is to enhance the quality of the final copper product and meet standards relating to appearance (surface quality), electrical conductivity and physical behavior during fabrication and use.

Poor surface quality is generally indicative of a defective casting and industry employs a variety of tests to monitor this problem. The reason for a defective casting may be any of known and unknown reasons and one of the important tests uses an eddy-current defectometer (Defectomat Instrument) which records surface defects on the basis of severity. The surface quality detector may be employed at any position in the rod line after the metal is cast (e.g., after the caster and before the rolls; etc.) and is usually employed before the coiler and there is considered to be a direct correlation between the number of recorded defects and product quality. In general, constant checking of the recordings from the surface quality detector shows that the number of defects increases during the process because of roll wear and other mechanical problems and the detector enables the operator to determine when maintenance and adjustment of the rolls should be performed.

While various automatic mechanical type control techniques such as the surface quality detector are used in continuous casting systems, these techniques provide a relatively simple system for monitoring surface quality and do not control the more significant variables within the process, either directly or indirectly.

It is therefore an object of the present invention to provide a novel system for the control of a continuous metal casting process.

Another object is to provide an improved method for the manufacture of copper and especially copper containing oxygen, e.g., rod, tube, sheet and other forms by continuous casting.

Other objects and advantages of the present invention will become apparent from the following detailed description.

SUMMARY OF THE INVENTION

It has now been discovered that the method for making copper by continuous casting may be improved by using an analyzer instrument employing a probe which is inserted into the molten copper and which provides a comparative reading based on the gases present in the molten metal and/or formed in the probe or at the probe interface, which reading is used to control parameters of the process such as the fuel/air ratio of the burners employed in the melting furnace, launders and/or holding furnace. The readings have been found to correlate with the surface quality of the cast product.

A preferred analyzer instrument is sold by Bomem Inc. under the name AlSCAN and its operation and use are fully described in U.S. Pat. No. 4,907,440, which patent is hereby incorporated by reference. The instrument consists of two units, the analyzer and the probe, and was developed to measure the hydrogen content of liquid aluminum and related alloys. Other suitable probes and analyzers may be used such as that used in the "Telegas" process described in U.S. Pat. No. 2,861,450 granted to Ransley et al. For convenience, the following description will be directed to use of the AlSCAN instrument although other instruments may be used as will be appreciated by those skilled in the art.

Broadly stated, the method for making copper by continuous casting comprises:

(a) melting copper in a furnace employing one or more burners;

(b) transferring the melted copper to a holding zone which is preferably heated;

(c) inserting into the molten copper a probe body preferably comprising a gas-permeable, liquid-metal-impervious material of sufficient heat resistance to withstand immersion in the molten copper, said probe having a gas inlet to its interior and a gas outlet therefrom, the gas inlet and gas outlet being spaced from one another so that a carrier gas passing from the inlet to the outlet traverses a substantial portion of the probe body interior for entrainment of gas diffusing to the interior of the body from the molten metal;

(d) comparing with an analyzer instrument the entrained gas and carrier gas mixture and the carrier gas using electronic measuring means, e.g., the difference in resistivity of resistance wires for the carrier gas and the entrained gas and carrier gas mixture; and (e) adjusting, if necessary, the fuel/air ratio of one or more of the burners, the oxygen content of the molten copper or other operating parameters based on the analyzer results; and (f) repeating steps (c)–(e) during the casting operation.

DESCRIPTION OF THE DRAWINGS

The invention will be best understood from the following specific description taken in conjunction with the accompanying drawings wherein.

DETAILED DESCRIPTION OF THE INVENTION

In general, the AlSCAN instrument relates the difference in the electronic measurements to the concentration of the gases in the molten metal and this value is outputted as an analyzer reading. As described in U.S. Pat. No. 4,907,440, the analyzer when used in molten aluminum measures the difference in resistivity of a bridge circuit which correlates this difference to the amount of hydrogen in the molten aluminum (see dotted line in FIG. 2). As discussed in the patent, the difference in resistivity of the resistance wires is caused by, in effect, a difference in thermal conductivity of the entrained and carrier gas mixture and the carrier gas. When hydrogen is present in the aluminum the gas mixture thus contains hydrogen and the thermal conductivity is higher than the carrier gas and causes increased cooling of the wire, which difference is electronically measured and correlated.

Referring again to FIG. 2, it can clearly be seen that use of the probe 15 in an aluminum system to measure hydrogen is completely different from its use in the more complex copper metallurgical system where oxygen and hydrogen are both in solution but not necessarily in equilibrium with each other especially during the continuous casting process where the variables are constantly changing. Other gases and copper oxide generated in the process are also present in the melt. Thus, as shown by the dotted line and in U.S. Pat. No. 4,907,440, the analyzer readings reach a peak and that peak is maintained (in equilibrium) during immersion in the molten aluminum. The peak is correlated to measure the hydrogen level of the melt in the aluminum system. In the copper system however, which contains a number of other gases, particularly oxygen, it is hypothesized that an initial peak is usually obtained which probably represents hydrogen, but that the readings often fall to a lower equilibrium value because gases in the copper system combine either in the probe or at the melt-probe interface to produce a different gas mixture than existing in the melt, said mixture having different thermal conductivities from the individual gases present in the melt. Depending on the probe design, flow of metal around the probe, operation of the instrument, etc., a peak may not be obtained but rather readings which reach an equilibrium value.

Figure 1:
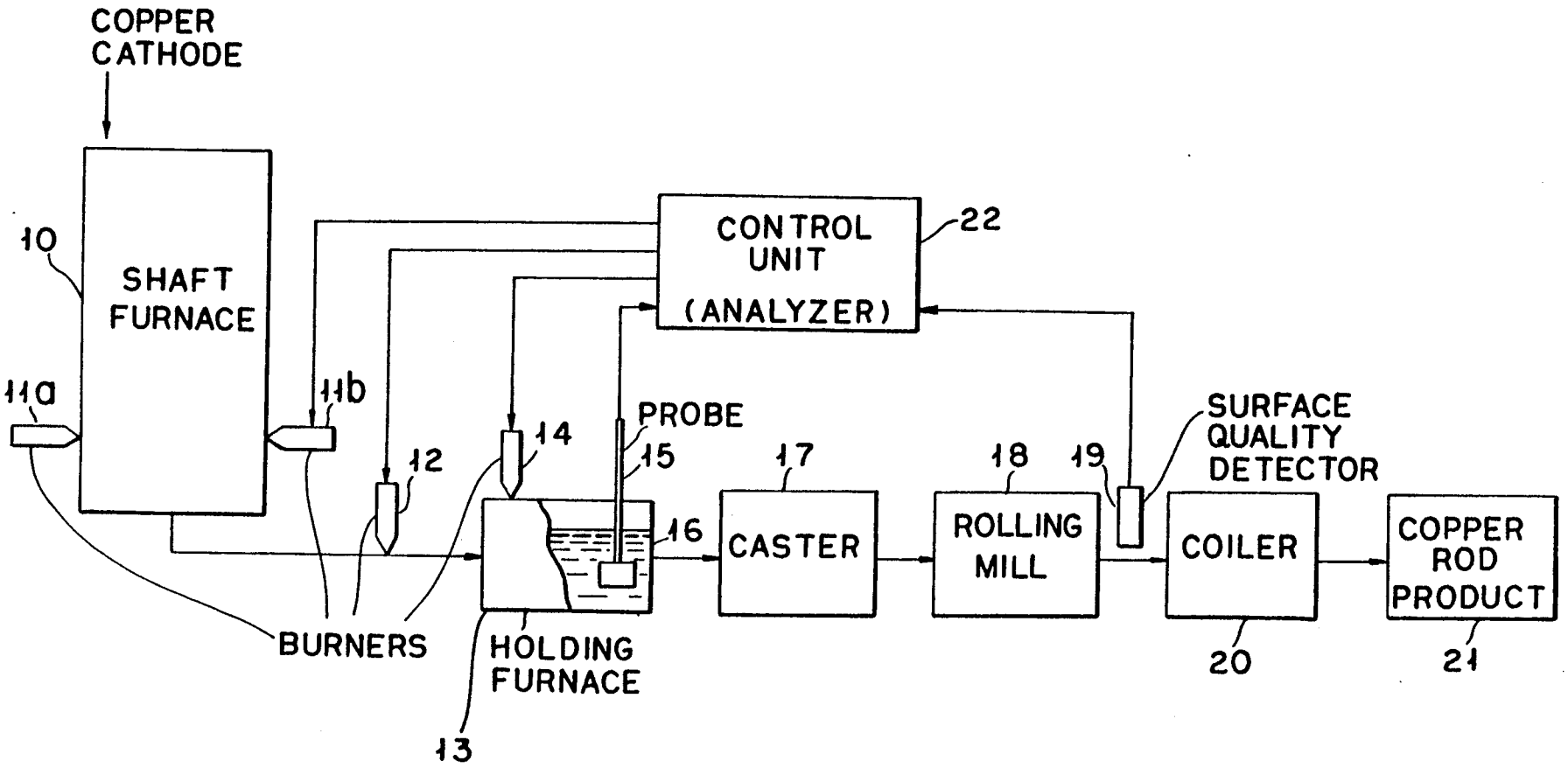
FIG. 1 shows a typical process flow chart of a copper rod continuous casting manufacturing process including as a portion thereof the use of the present invention.

Referring now to FIG. 1, a typical copper continuous casting process in conjunction with using the probe (analyzer) and method of the invention is shown. Copper cathodes or other copper forms are added to the shaft furnace 10 and melted using burners 11*a* and 11*b*. Molten copper flows from the furnace into holding furnace 13. The molten copper may be heated during transfer from the shaft furnace 10 to holding furnace 13 by burner 12 and in the holding furnace by burner 14. Probe 15 is inserted into the molten copper 16 and the entrained gas mixture from the probe is relayed to control unit 22. The probe may also be inserted, for example, into the launder connecting the shaft furnace 10 to the holding furnace 16, the launder connecting the holding furnace 16 to the caster 17 or in the tundish of the caster 17. A separate analyzer instrument may be used to electronically compare the gases entrained in the probe with the results inputted to control unit 22. In FIG. 1, the control unit 22 also contains the analyzer instrument as an integral part thereof and which measures and compares the entrained gas-carrier gas mixture in the probe with the carrier gas and provides an analyzer reading to be used by the control unit. The molten copper 16 is fed into caster 17 and the casting fed into rolling mill 18 to produce the copper rod product 21. Coiler 20 is normally employed to coil the copper for storage. A surface quality detector 19 is used to measure the surface quality of the rod with the output being relayed to control unit 22. Based on the signals relayed to the control unit 22 by detector 19 and probe (analyzer) 15, control signals are relayed to the burners to adjust, if necessary, the fuel/air ratios.

Control signals may also be used to adjust other process variables to control the process. For example, oxygen levels, adjusting of particular burners in the system, exposing the copper to other reducing or oxidizing agents, purging of the copper with neutral substances (nitrogen), temperature level, agitation of the melt to remove gases, etc. In one embodiment, control of the oxygen level based on the analyzer results may be accomplished using an oxygen probe which measures the amount of oxygen in the molten copper.

In a typical run the oxygen level of the copper will be controlled at a level of about 100–450 ppm, preferably 140–400 ppm and most preferably 240 to 280 ppm by introduction of air into or over the surface of the copper.

Figure 2:
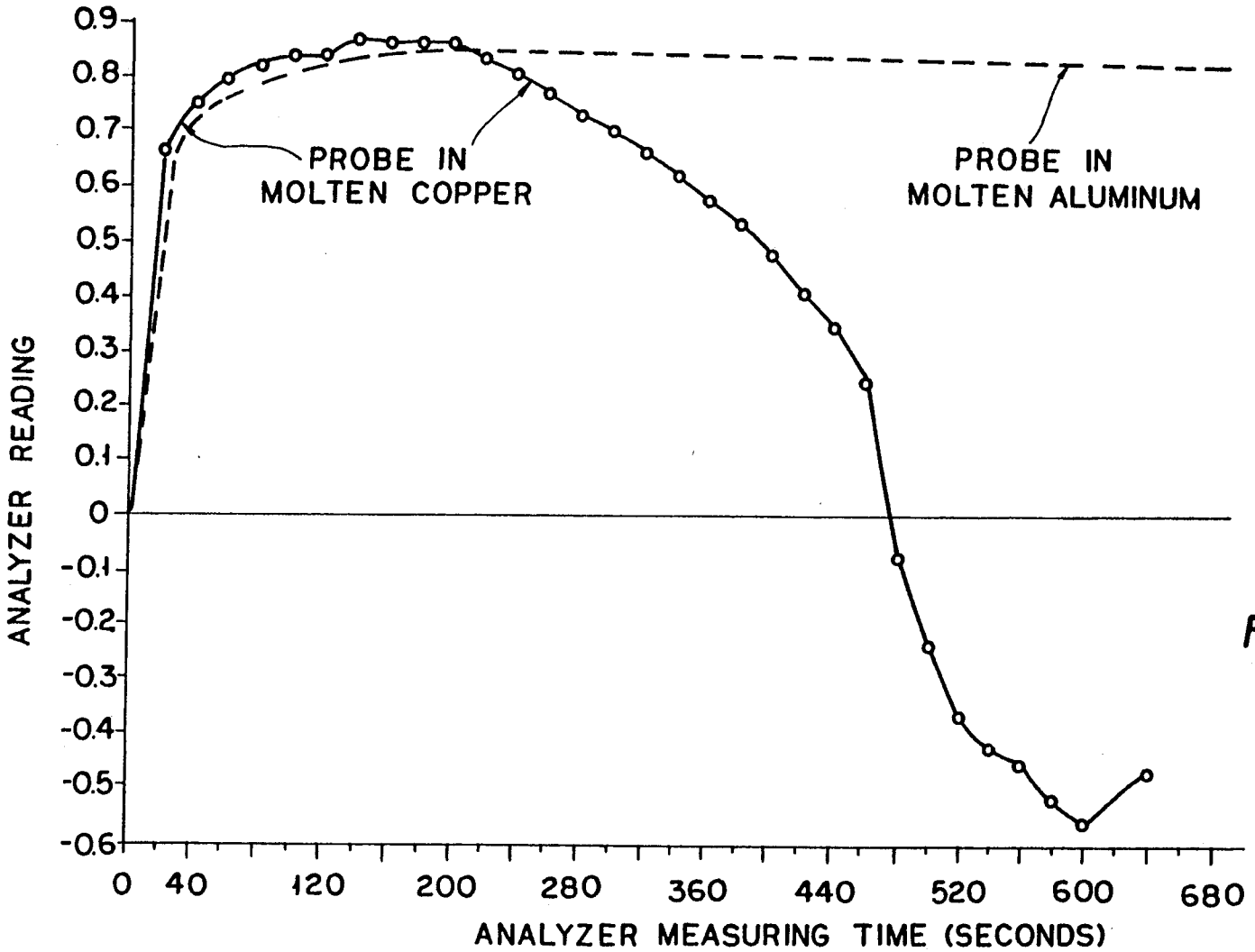
FIG. 2 is a graph comparing typical analyzer instrument readings versus time when the probe is used to measure molten copper and molten aluminum.

In operation, the probe 15 will be inserted into the molten copper 16 and signals from the analyzer will be sent to control unit 22 based on the gases in the molten metal. Referring to FIG. 2, a typical curve is shown of the probe (analyzer) readings versus immersion time in the molten copper 16.

Basically, the preferred probe 15 consists of a monolithic body of a gas-permeable, liquid-metal-impervious material having a desired porosity and pore size. The porosity is defined as the proportion of the total volume of the body that is occupied by the voids within the body and a suitable range is about 5% to about 80% or higher. The pore size can vary over a wide range usually about 0.5 micrometers to 2,000 micrometers or higher.

Generally, tubes extend into the probe body 15, one tube for introducing the carrier gas and the other tube for transferring the carrier gas and, after immersion in the molten copper, entrained gases from the molten metal (and any gases formed within the probe body) to an analyzer which electronically measures and compares the carrier gas and the entrained molten metal gases and carrier gas mixture. The analyzer computes an output which is used by the control unit 22 to control the process. It is an important feature of the invention that it be understood that the term entrained metal gases include gases which are formed within the probe or at the probe-molten metal interface by individual gases existing in the molten metal combining (e.g., chemical reaction) due to the temperature, proximity of the gases in the probe, probe-melt interface reaction, etc.

In a typical copper rod manufacturing operation, the probe 15 will be flushed with a carrier gas, such as nitrogen, for a length of time to ensure that only nitrogen remains in the circuit. The flushing is then stopped and the probe 15 immersed into the molten copper 16 with the volume of carrier gas in the circuit being constantly circulated through the probe and the analyzer electrical measuring means. Upon immersion, the gases in the molten copper 16 enter the porous probe body 15 and the circulation of the carrier gas and entraining gases is continued for a period of time known to establish substantial equilibrium. At the end of this period or continually over this time period as shown in FIG. 2, the analyzer takes a measurement of the electronic comparative difference between the carrier gas and entrained gases and carrier gas mixture and converts this difference into an analyzer reading.

While the instrument may be normalized or correlated to produce readings based on any scale, FIG. 2 shows that when the probe and analyzer are used as detailed in U.S. Pat. No. 4,907,440, the readings are both positive and negative indicating that the electrical resistance (thermal conductivity) of the entrained gases is changing over time and, finally at substantial equilibrium, is often less than the electrical resistance (thermal conductivity) of the carrier gas and less than hydrogen. This equilibrium will be effected by the probe properties (pore size, etc.) and has been found using a commercial instrument (AlSCAN Instrument (HMA0100D) made by Bomem Inc.) to be established after immersion for at least about 5 minutes, usually 8–10 minutes, and the readings obtained will remain fairly constant after this time barring upsets in the rod manufacturing process.

Figure 3:
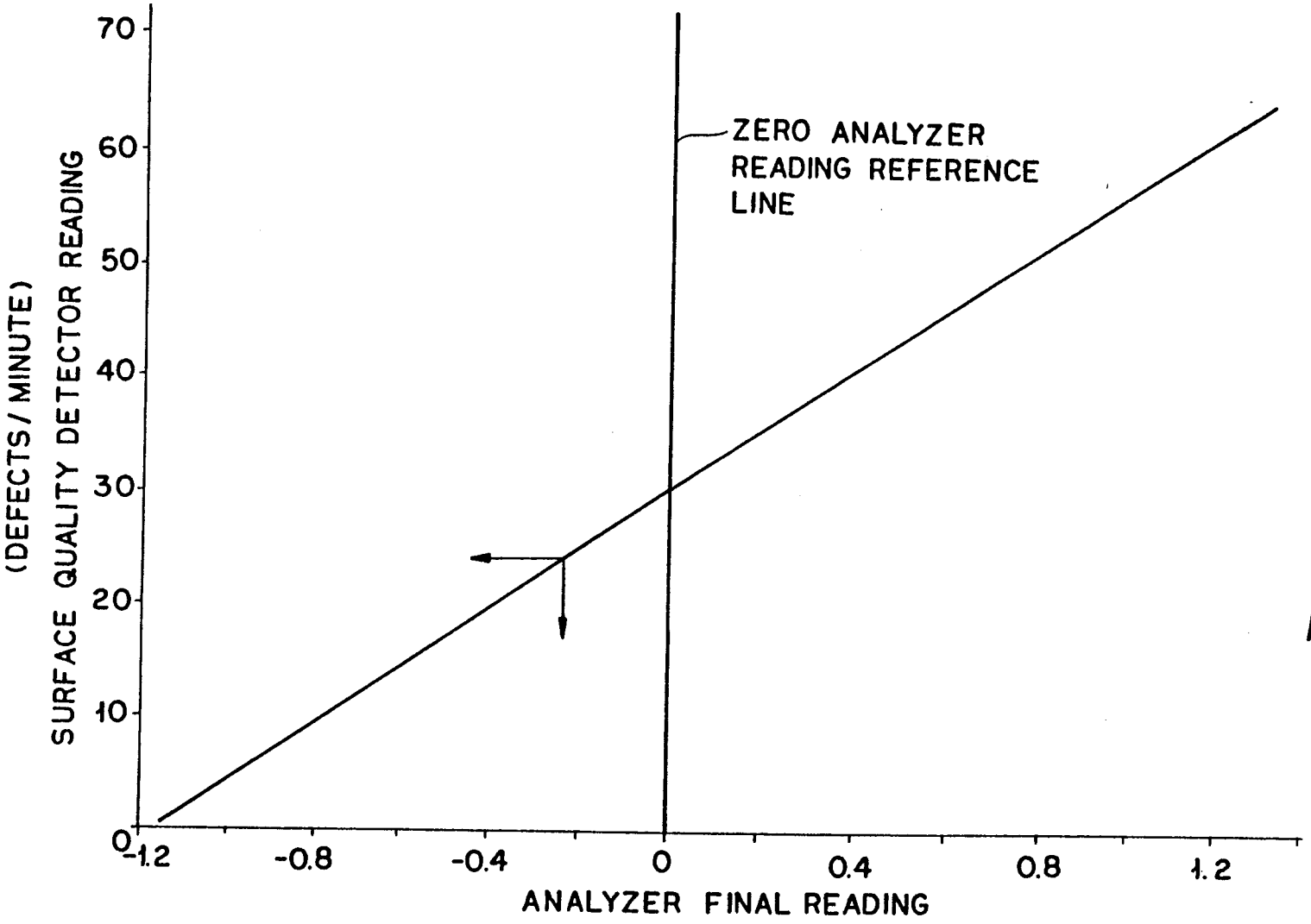
FIG. 3 is a graph of a surface quality detector's readings versus analyzer final (equilibrium) readings obtained in the process for making copper rod.

It is an important feature of the invention that certain of the analyzer readings be used to control the process using the control unit 22 since the readings have been found to correlate with the surface quality of the rod as shown in FIG. 3.

FIG. 2 is a typical curve obtained using the AlSCAN probe and analyzer in molten copper and the final analyzer reading, taken as the lowest point in the curve, correlates with the number of defects as shown in FIG. 3. Similarly to the lowest reading point, analyzer readings obtained at substantial equilibrium may also be used to control the process. Substantial equilibrium may be defined as that point in the gas analysis process where the analyzer results remain substantially constant over time. Referring to FIG. 2, substantial equilibrium was reached after about 520 seconds and readings of between about −0.35 and −0.6 would continually be obtained as long as the probe was immersed in the molten copper during its measuring and analyzing cycle and before it is purged and prepared for another analysis cycle.

Another control parameter for the process is based on maintaining the analyzer readings at a negative value. The negative value indicates that the thermal conductivity of the entrained gas mixture is less than the thermal conductivity of the nitrogen carrier gas and this too correlates with the surface quality detector readings. It will be appreciated by those skilled in the art that this negative reading is dependent on using nitrogen as the carrier gas and that if another gas were used, the control value would change.

There may be many other ways to control the system and another control parameter correlates the difference between the peak and lowest value reading and surface defects.

Regardless of the mechanism with which the probe 15 samples and measures the gases in the molten copper, operation of the manufacturing process using the above readings provides a significantly enhanced process. Thus, as can be seen from FIG. 3, operating the process to provide probe (analyzer) readings of less than zero will result in fewer surface defects. It has been found that if the value obtained is rising, the fuel/air ratios of the shaft furnace and/or other burners are normally decreased.

In a typical operation, the probe 15 is activated and readings obtained. If the readings after equilibrium are negative no changes are made to the process. If lower readings are desired, the fuel/air ratios will be decreased and a new equilibrium value obtained. If higher readings are desired, the fuel/air ratios of the shaft furnace burners are normally increased. Oxygen levels will normally not be changed and will continue to be monitored and maintained at desired operating levels. Operation of a commercial shaft furnace and caster and rolling mill using this procedure resulted in a controlled process with the rod having fewer surface defects than when operated without the gas analysis probe.

It will be apparent that many changes and modifications of the several features described herein may be made without departing from the spirit and scope of the invention. It is therefore apparent that the foregoing description is by way of illustration of the invention rather than limitation of the invention.

We claim:

1. A method for making copper by continuous casting comprising:

(a) melting copper in a furnace employing burners;

(b) transferring the melted copper to a heated holding zone;

(c) inserting into the molten copper a probe body comprising a gas-permeable, liquid-metal-impervious material of sufficient heat resistance to withstand immersion in the molten copper, said prove having a gas inlet to its interior and a gas outlet therefrom, the gas inlet and gas outlet being spaced from one another so that a nitrogen carrier gas passing from the inlet to the outlet traverses a substantial portion of the probe body interior for entrainment of gas diffusing to the interior of the body from the molten metal;

(d) comparing with an analyzer instrument the entrained gas-nitrogen carrier gas mixture and the nitrogen carrier gas using electronic measuring means;

(e) adjusting, if necessary, the fuel/air ratio of one or more of the burners based on the analyzer readings obtained when the readings reach substantial equilibrium; and (f) repeating steps (c)–(e) during the casting operation.

2. The method of claim 1 wherein the adjusting step (e) is based on the lowest analyzer reading obtained during the measurement cycle.

3. The method of claim 1 wherein the fuel/air ratios of the burners are adjusted to maintain a negative analyzer reading.

4. The method of claim 3 wherein the copper product contains oxygen.

5. A method for making copper by continuous casting comprising:

(a) melting copper in a shaft furnace using burners;

(b) measuring gases in the molten copper using a probe immersed in the copper to entrain the gases therein, said probe having a gas inlet to its interior and a gas outlet therefrom, the gas inlet and gas outlet being spaced from one another so that a carrier gas passing from the inlet to the outlet entrains gas present in the molten copper;

(c) comparing with an analyzer instrument the entrained gas-carrier gas mixture and the carrier gas using electronic measuring means;

(d) adjusting, if necessary, the fuel/air ratio of one or more of the burners based on the equilibrium analyzer readings value; and (e) repeating steps (b)–(d) during the casting operation.

6. The method of claim 5, wherein the melted copper is transferred to a holding zone which is heated by burners, which burners may also be adjusted based on the measurements obtained.

* * * * *

UNITED STATES PATENT AND TRADEMARK OFFICE

CERTIFICATE OF CORRECTION

PATENT NO. : 5,293,924
DATED : March 15, 1994
INVENTOR(S) : John R. Hugens, Jr. et al.

It is certified that error appears in the above-indentified patent and that said Letters Patent is hereby corrected as shown below:

Column 7, line 23, "prove" should read --probe--.

Signed and Sealed this

Twenty-fourth Day of January, 1995

*Attest:*

Bruce Lehman

BRUCE LEHMAN

*Attesting Officer*

*Commissioner of Patents and Trademarks*